United States Patent [19]

Ogihara et al.

[11] 4,423,966

[45] Jan. 3, 1984

[54] ALARM CONTROL SYSTEM FOR ALARM CLOCK

[75] Inventors: Masuo Ogihara; Nobuo Shinozaki; Tadashi Ishikawa; Yoichi Seki, all of Yotsukaido, Japan

[73] Assignee: Seiko Koki Kabushiki Kaisha, Tokyo, Japan

[21] Appl. No.: 218,181

[22] Filed: Dec. 19, 1980

[30] Foreign Application Priority Data

Jan. 30, 1980 [JP] Japan ..... 55/9712

[51] Int. Cl.[3] ..... G04B 23/00

[52] U.S. Cl. ..... 368/263; 368/74; 368/320; 368/321

[58] Field of Search ..... 368/263, 319, 320, 321, 368/74

[56] References Cited

U.S. PATENT DOCUMENTS 4,307,460 12/1981 Polonsky ..... 368/263

FOREIGN PATENT DOCUMENTS 5242150 4/1979 Japan ..... 368/263

*Primary Examiner*—Bernard Roskoski

*Attorney, Agent, or Firm*—Robert E. Burns; Emmanuel J. Lobato; Bruce L. Adams

[57] ABSTRACT

The alarm control button of the alarm clock with a snooze mechanism is operable in two modes; a lateral sliding mode and a vertical pushing mode. The alarm setting and the permanent stopping of the buzzer are controlled by the sliding mode, while the temporary stopping of the buzzer is controlled by the vertical pushing mode.

2 Claims, 10 Drawing Figures

ALARM CONTROL SYSTEM FOR ALARM CLOCK

BACKGROUND OF THE INVENTION

This invention relates to an alarm setting device of an alarm clock and more particularly relates to an alarm setting and buzzer stopping device of an alarm clock with a snooze mechanism.

In the conventional alarm clock of this type, an alarm setting/buzzer stopping button and a snooze button are separately provided. According to this conventional arrangement, the accessibility of one of the buttons is sacrificed as the alarm setting/buzzer stopping button and the snooze button have to be separately positioned. In a small-sized alarm clock it is disadvantageous to share extra space for two buttons.

SUMMARY OF THE INVENTION

Accordingly, an object of the present invention is to provide a mechanism which is capable of providing both of the functions using a single button. According to the present invention, the object of the invention is attained by an alarm clock button which performs alarm setting or permanent buzzer stopping by operating a first switch connected to an alarm control circuit during its lateral sliding movement, and temporary stopping of the alarm device by operating a second switch during its vertical pushing movement.

DETAILED DESCRIPTION OF THE INVENTION

Figure 1:
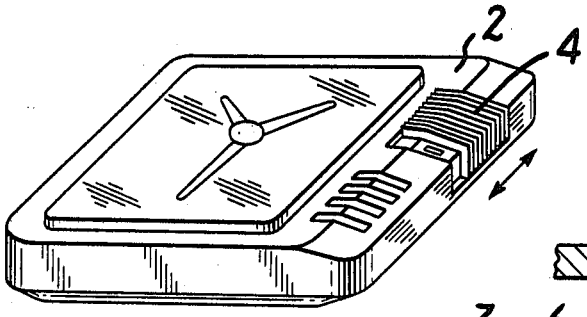
FIG. 1 is a perspective view illustrating a first embodiment according to the present invention, FIGS. 2-*a* and 2-*b* are sectional views of the first embodiment.
Figure 2A:
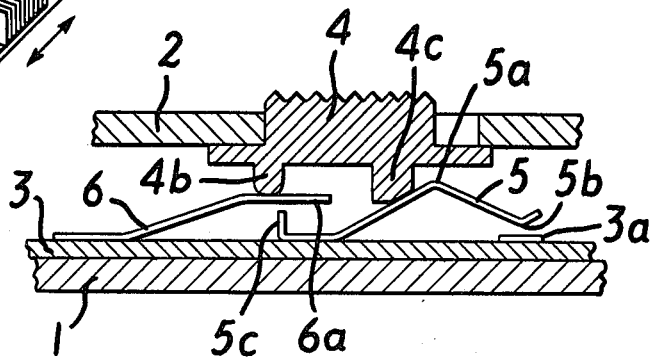
Figure 2B:
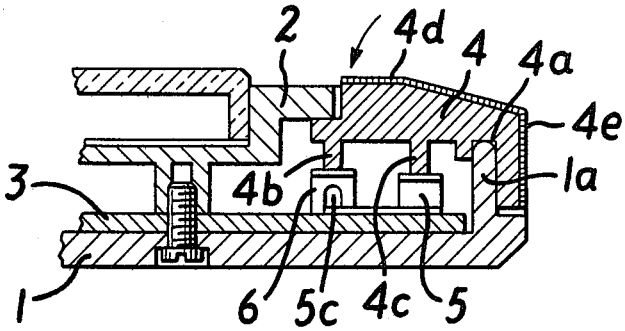
Figure 3:
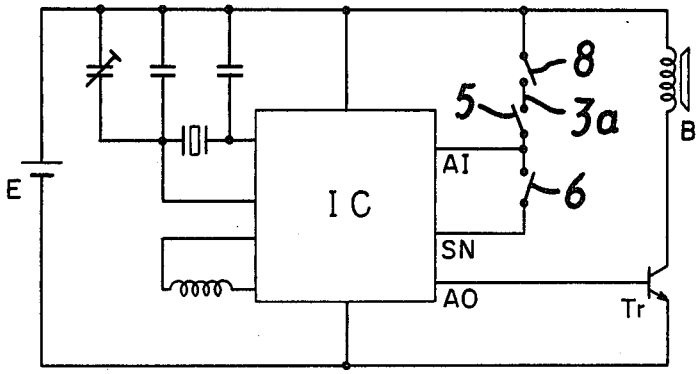
FIG. 3 is a diagram of an electric circuit of the present invention.

Referring first to FIGS. 1 to 3, explanation will be made of a first embodiment according to the present invention. A top case 2 and a bottom case 1 are fixed together by screws. A printed circuit board 3 comprising circuit elements as shown in FIG. 3 and an alarm control button 4 are supported in the case. The alarm control button 4 has a groove 4*a*, a pin 4*b* and a cam 4*c*. The groove 4*a* is engaged with a guide rail 1*a* formed on the bottom case 1 so that the control button 4 is slidable in the directions of the arrow shown in FIG. 1. The alarm control button 4 is adapted to be swingable about the guide rail 1*a* of the bottom case as shown in FIG. 2. A first contact plate 5 and a second contact plate 6 are attached to the printed circuit plate 3. The first contact plate 5 has an operating part 5*a* engageable with the cam 4*c* of the alarm control button 4, a first contact point 5*b* arranged to be able to contact with a first pattern 3*a* of the printed circuit board 3, and a second contact point 5*c* arranged to be able to contact with the second contact plate 6. The contact part 6*a* of the contact plate 6 is continuously in contact with the pin 4*b* of the alarm control button 4 urging the same upward. When the alarm control button 4 is turned counterclockwise as shown by the arrow (FIG. 2(*b*), the pin 4*b* bends the contact part 6*a* of the contact plate 6 so that the second contact plate 6 and the first contact plate 5 come in contact with each other.

An alarm control circuit (IC) directly connected to a power source (E) has an alarm input teminal (AI), an alarm output terminal (AO), and a snooze terminal (SN). The first contact plate 5 is connected to the input terminal (AI), while the base of a transistor (Tr) is connected to the output terminal (AO). The collector of the transistor (Tr) is connected to the negative electrode of the power source (E), through a buzzer B while the emitter of the transistor (Tr) is connected to the positive electrode of the power source (E) through a. A third contact plate 8 is connected to the positive electrode of the power source (E). The third contact plate 8 operates at the alarm time detection in the manner well known in the operation of an alarm clock. The third contact plate 8 comes in contact with the first pattern 3*a* formed on the printed circuit board 3 at alarm time. When the alarm control button 4 is set to the setting position the first contact point 5*b* of the first contact plate is in contact with the first pattern 3*a*, therefore, when the third contact plate 8 comes in contact with the first contact pattern 3*a* with the alarm control button 4 at the setting position, the input terminal (AI) and the output terminal (AO) potential becomes high to actuate the transistor (Tr) so that the buzzer (B) is actuated. The second contact plate 6 is connected to the snooze terminal (SN), therefore, when the alarm control button 4 is turned counterclockwise from the position shown in FIG. 2, the pin 4*b* of the alarm control button pushes the contact part 6*a* of the second contact plate 6 to make the second contact plate 6 contact with the first contact plate 5 so that the output of the alarm output terminal (AO) is interrupted, however, this interruption of the output is controlled by a counting circuit included in the alarm control circuit (IC) and the potential of the output terminal (AO) is restored after a fixed period of time, for instance five minutes later, so that the buzzer (B) is actuated again. The upper surface 4*d* and the side surface 4*e* of the alarm control button 4 are knurled to facilitate the operation of the alarm control button 4 so that the side surface 4*e* is used in the alarm setting/permanent stopping operation while the upper surface 4*d* is used in depressing the alarm control button 4 for the temporary alarm interruption.

Figure 4:
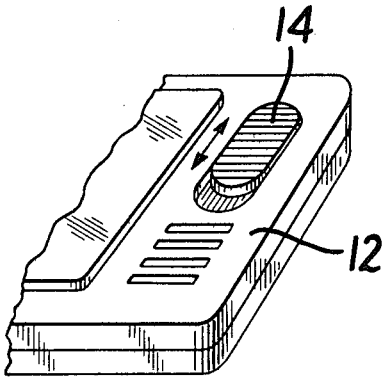
FIG. 4 is a partial perspective view of a second embodiment according to the present invention, FIGS. 5-*a* and 5-*b* are sectional views of the second embodiment.
Figure 5A:
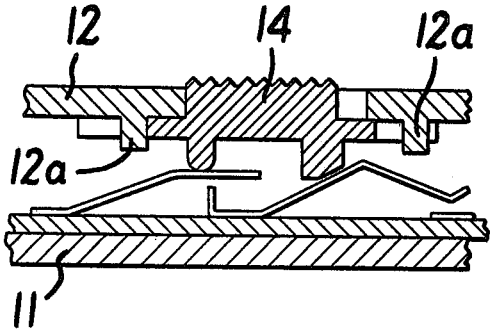
Figure 5B:
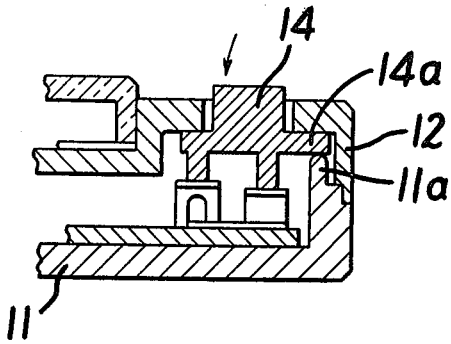
Figure 6:
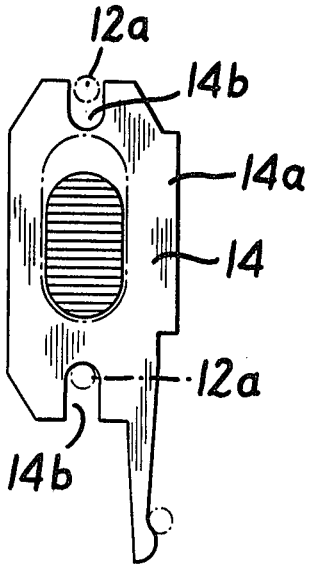
FIG. 6 is a plan view of the control button of the second embodiment.

Referring now to FIGS. 4 to 6 illustrating a second embodiment according to the present invention, explanation will be made of the part of the second embodiment which is different from the first embodiment.

Alarm control button 14 is supported between a top case 12 and a bottom case 11 with an extending part 14*a* guided along a guide rail 11*a*. The lateral movement of the alarm control button 14 is limited by two pins 12*a* formed on the top case 12 and engaging with the respective slots 14*b* formed on the alarm control button 14 (FIG. 4). The pins 12*a* are loosely fitted in the slots 14*b* with a suitable space between them to allow counterclockwise swing motion of the alarm control button about the guide rail 11*a* when the alarm control button 14 is depressed in the direction shown by the arrow (FIG. 5). The rest of the structure being the same as that of the first embodiment, further explanation will be omitted to avoid duplication.

Figure 7:
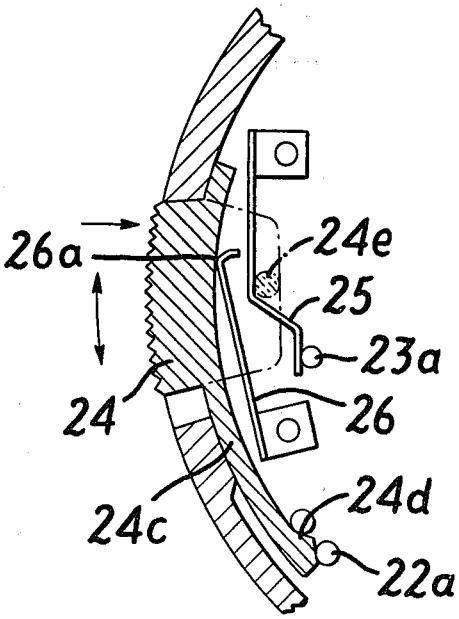
FIG. 7 is a plan view of a third embodiment according to the present invention.
Figure 8:
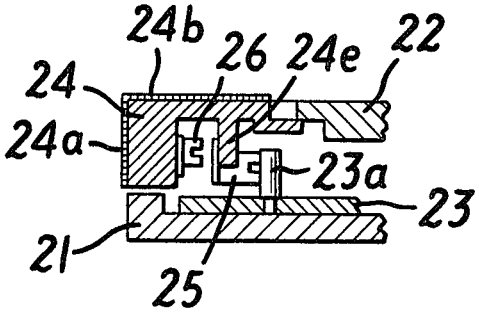
FIG. 8 is a sectional view of the third embodiment.

Referring to FIGS. 7 and 8 illustrating a third embodiment according to the present invention, explanation will be made of the part different from the first embodiment.

The alarm control button 24 is supported between a top case 22 and a bottom case 21 similar to the first embodiment and formed in an arc of a circle in plan. Normally the alarm control button slides along the circular inner surface of the case. The control button 24 has a knurled first operating surface 24*a*, a second operating surface 24*b* arranged substantially perpendicularly to the first operating surface 24*a* and a guiding part 24*c* extending in the form of an arc of a circle. A click 24*d* projecting from the guiding part 24*c* engages with a pin 22*a* formed on the bottom case 22 when the alarm control button is moved along the circular inner surface of the case to click-stop the alarm control button 24 at fixed positions by the resilient force of the guiding part 24*c*. A first contact plate 25, a second contact plate 26 and a switch pin 23*a* are attached to a printed circuit board 23. The first contact plate 25 and the switch pin 23*a* are connected to the input terminal (AI) and the first pattern 3*a* of the control circuit of FIG. 3 respectively. The first contact plate 25 is operated by the pin 24*e* formed on the alarm control button 24 and contacts the switch pin 23*a* when the alarm control button 24 is turned clockwise, consequently, when the third contact plate 8 shown in the circuit diagram is closed at alarm time, positive potential is applied to the output terminal (AO) of the control circuit so that the buzzer (B) is actuated. The second contact plate 26 connected to the snooze terminal (SN) of the control circuit is in contact with the inner surface of the alarm control button 24 at its end (26*a*) urging the alarm control button 24 counterclockwise. When the buzzer (B) is actuated in the manner as hereinbefore described and the alarm control button is pushed at the first operating surface 24*a*, the alarm control button 24 turns clockwise about the click 24*d* so that the second contact plate also is shifted rightwards and comes in contact with the first contact plate 25. Consequently, the buzzer (B) is temporary stopped as in the explained with the first embodiment and actuated again after a fixed period of time.

It will be obvious from what has been described hereinbefore that according to the present invention, alarm setting, permanent buzzing stopping and temporary buzzing stopping can be controlled by operating a single alarm control button, furthermore, the construction of the present invention is advantageous from the point of view of cost as the number of component parts is reduced and from the point of view of space in the case of small-sized clocks.

We claim:

1. In an alarm clock, the combination comprising:

an alarm clock case having a side portion with an elongate slot therethrough;

a single alarm control button dimensioned to fit within and extend through the elongated slot and dimensioned to travel within said slot along the length dimension of said slot and pivot downwardly about one edge of said alarm control button down into the elongate slot;

mounting means for mounting said alarm control button within and extending through the elongate slot slidable along the length dimension of the elongate slot and pivotal about one edge of said alarm control button down into the elongate slot;

a first switch positioned for engagement with said alarm control button and opened and closed according to the position of said alarm control button along the length dimension of the elongate slot;

a second switch positioned for engagement with said alarm control button and opened and closed according to the position of said alarm control button as it is pivoted about said one edge of said alarm control button; and an alarm control circuit having an alarm mode control input connected to said first switch so that the position of said alarm control button along the length dimension of the elongate slot controls an alarm mode and having a snooze mode control input connected to said second switch so that the position of said alarm control button pivoted about said one edge of said alarm control button controls the snooze mode.

2. In an alarm clock, the combination comprising: an alarm clock case having a side portion with an elongate slot therethrough; a single alarm control button dimensioned to fit within and extend through the elongate slot and dimensioned to travel within said slot along the length dimension of said slot and pivot downwardly about one edge of said alarm control button down into the elongate slot; mounting means for mounting said alarm control button within and extending though the elongate slot slidable along the length dimension of the elongate slot and pivotal about one edge of said alarm control button down into the elongate slot; a first switch positioned for engagement with said alarm control button and opened and closed according to the position of said alarm control button along the length dimension of the elongate slot; a second switch positioned for engagement with said alarm control button and opened and closed according to the position of said alarm control button as it is pivoted about said one edge of said alarm control button; an alarm control circuit having an alarm mode control input connected to said first switch so that the position of said alarm control button along the length dimension of the elongate slot controls an alarm mode and having a snooze mode control input connected to said second switch so that the position of said alarm control button pivoted about said one edge of said alarm control button controls the snooze mode; the elongate slot through said clock case being generally rectilinear, said alarm control button having a pair of opposed parallel edge portions, and said mounting means comprising a straight guide within said clock case extending along and parallel to one length edge of the elongate slot, and a groove in a surface of said control button and extending along the length of said alarm control button, the groove in the control button being dimensioned to receive said straight guide to permit said alarm control button to slide along said straight guide and to pivot about an axis defined by a line of contact between said straight guide and said alarm control button, and said alarm control button being positioned inserted within and extending through the slot through said clock case with said straight guide inserted into the straight groove in said alarm control button, whereby said alarm control button is mounted within and extending through the elongate slot slidable along the length dimension of the elongate slot and pivotal about one edge of said alarm control button down into the elongate slot; and said clock case has a pair of opposite main surfaces and side surfaces extending between said pair of opposite main surfaces, said main surfaces meeting said side surfaces along straight edges of said clock case, the elongate slot through said clock case having a portion through one of the main surfaces of said clock case and having a portion through one of the side surfaces of said clock case adjacent said main surface with the length dimension of the elongate slot extending parallel to the straight edge of said clock case at which said main surface and said side surface of said clock case meet, said alarm control button having a pair of surface portions for pressing to operate said alarm control button, said pair of surfaces comprising a first surface generally parallel to said main clock case surface through which the elongate slot extends and a second surface generally parallel to said side clock case surface through which the elongate slot extends, and said guide comprising a thin upstanding wall-like rail generally perpendicular to said first surface of said alarm button with a free end extending to the groove of said alarm control button so that pressing on said first surface is effective to pivot said alarm control button about the line of contact between said guide and said alarm control button and pressing on said second surface is effective to slide said alarm control button along said guide in the length direction of the elongate slot.

* * * * *